United States Patent [19]

Innis

[11] Patent Number: 4,712,389

[45] Date of Patent: Dec. 15, 1987

[54] FLOWER HOLDER JEWELRY ARTICLE

[76] Inventor: Pamela B. Innis, 2733 St. Laurent Pl., La Jolla, Calif. 92037

[21] Appl. No.: 920,447

[22] Filed: Oct. 20, 1986

[51] Int. Cl.[4] ..... A44C 1/00; A44C 15/00

[52] U.S. Cl. ..... 63/1 R; 24/6; 47/41.11

[58] Field of Search ..... 24/5, 6, 12; 63/20, 63/18, 1 R, 2, 1 A; 47/41 R, 41.11, 41.13, 41.12

[56] References Cited

U.S. PATENT DOCUMENTS

| | | | |
|---|---|---|---|
| 273,666 | 3/1883 | Carleton | 47/41.11 |
| 522,910 | 7/1894 | Marston | 47/41.11 |
| 1,096,180 | 5/1914 | Meurling | 47/41.11 |
| 1,379,340 | 5/1921 | Hegamin | 47/41.11 |
| 1,402,904 | 1/1922 | Skidmore | 47/41.11 |
| 1,828,295 | 10/1931 | Roy | 47/41.11 |
| 1,899,165 | 2/1933 | Rivet | 63/DIG. 2 |
| 2,486,848 | 11/1949 | Huck | 24/6 |
| 2,691,849 | 10/1954 | Ehlers, Sr. | 47/41.11 |
| 4,118,889 | 10/1978 | Lamlee | 47/14 |
| 4,208,888 | 6/1980 | Erdman | 63/2 |

FOREIGN PATENT DOCUMENTS

| | | | |
|---|---|---|---|
| 18701 | of 1898 | United Kingdom | 47/41.11 |
| 14233 | of 1912 | United Kingdom | 47/41.11 |

*Primary Examiner*—Richard J. Johnson

*Attorney, Agent, or Firm*—Baker, Maxham & Jester

[57] ABSTRACT

An item of jewelry combined with a fresh cut flower retained in water. A hollow cylinder of jewelry material such as silver or gold is adapted to be secured to a wearer by means of a chain or pin. A water holding vial having a resilient stopper on one end is frictionally retained within the cylinder by means of the stopper. Upon inserting a cut flower stem through one end of the cylinder and into the vial through the stopper, the jewelry item is completed.

7 Claims, 5 Drawing Figures

FIG. 1
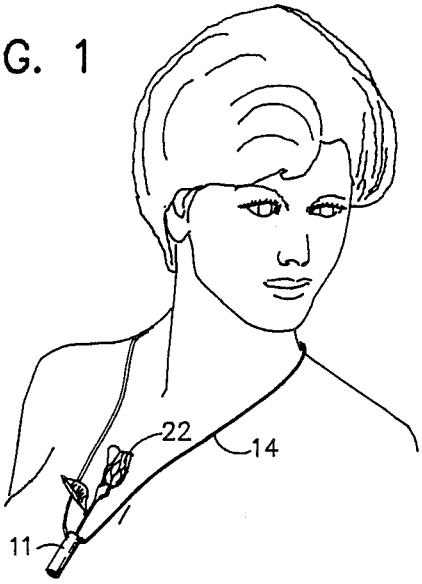
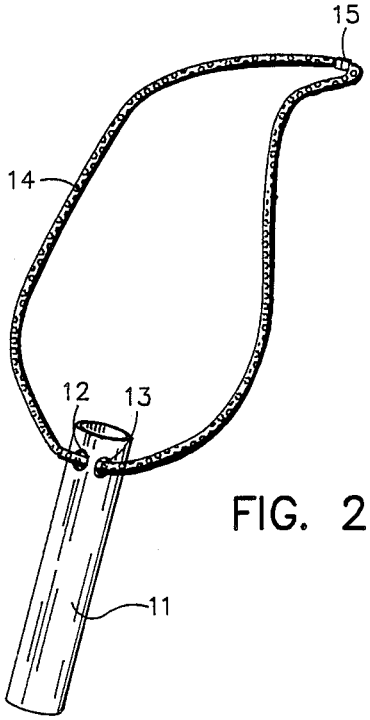
FIG. 2
FIG. 3
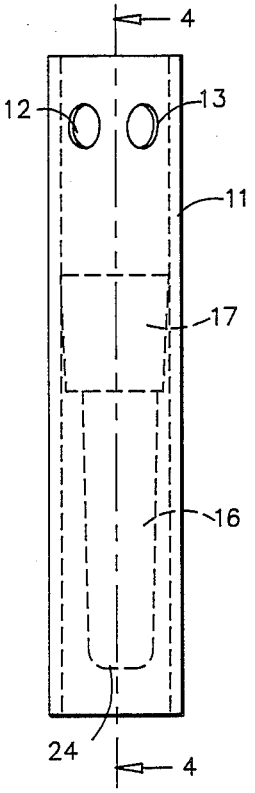
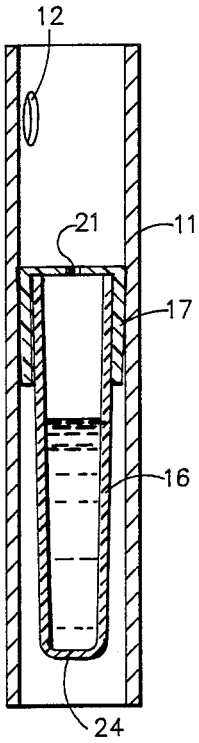
FIG. 4
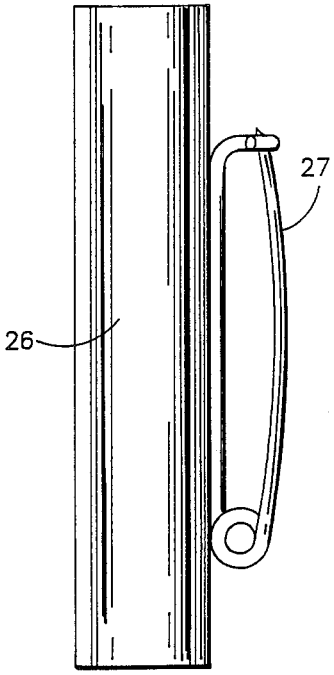
FIG. 5

FLOWER HOLDER JEWELRY ARTICLE

FIELD OF THE INVENTION

This invention relates generally to jewelry and more particularly to an item of jewelry including a natural, fresh cut flower.

DISCUSSION OF THE PRIOR ART

Flower holder tubes or vials with a resilient or rubber stopper on the top end, for receiving the stems of cut flowers therethrough, have been known for some time. These devices are often employed by florists.

Devices for holding a cut flower with its stem in water, to be worn by a person, have previously been suggested. One such item includes a simple vial with a stopper through which the stem of the flower extends. The vial is equipped with a pin for attaching the flower-holding vial to the clothing of the wearer, such as a man's jacket, with the flower extending through the lapel buttonhole. This is a means for providing a longer lasting boutonniere, not as an item of jewelry.

Another flower holder adapted to extend through a buttonhole with the open end being visible has also been proposed. This device has a flange around the top to maintain it in the buttonhole. Again it is merely a means to hold a flower and is not in itself decorative or capable of functioning as a piece of jewelry.

The previously known devices, while possibly being effective to retain a flower and keep it fresh for a substantial period of time, do not have any jewelry aspect but merely provided a boutonniere or buttonhole flower retaining device.

SUMMARY OF THE INVENTION

Broadly speaking, this invention relates to an item of jewelry adapted to include a fresh cut flower. A hollow cylinder or tubular member formed of jewelry material, typically a metal such as silver, is fitted with a vial, sometimes referred to as a stem tube. The cylindrical element is shaped and configured to receive the stem tube therein so that the resilient cap of the stem tube frictionally engages the inner surface of the cylinder, thereby retaining the stem tube firmly within the cylinder. The stem of a fresh cut flower is then inserted through one end of the jewelry cylinder and through the resilient cap into the stem tube which is partially filled with water, thereby retaining freshness of the flower for an extended period of time.

The flower is easily replaceable as desired. This can be done to maintain freshness, change colors or to match the mood of the wearer. Additionally, the vial is easily removed from the cylinder.

The jewelry item may be worn as a pendant by means of a chain or it may be secured to clothing by means of a pin.

BRIEF DESCRIPTION OF THE DRAWING

The objects, advantages and features of this invention will be more readily perceived from the following detailed description, when read in conjunction with the accompanying drawing, in which:

FIG. 1 is a perspective view of the invention as a pendant on a wearer;

FIG. 2 shows the chain and cylindrical member of the invention from the reverse side;

FIG. 3 is an enlarged elevational view of the cylindrical elements of FIG. 2;

FIG. 4 is a sectional view taken along cutting plane 4—4 of FIG. 3 showing more clearly how the stem tube is secured within the cylinder; and FIG. 5 shows an alternative embodiment of the invention.

DESCRIPTION OF THE PREFERRED EMBODIMENTS

With reference to the drawing, there is shown a hollow tubular or cylindrical member 11, preferably formed of precious metal such as silver or gold. Other substances appropriate for making such jewelry items could be used for the substantially rigid cylinder. The cylinder is formed with holes 12 and 13 through which pass chain 14 having a typical clasp 15, adapted to be removably secured around the neck of the wearer as shown in FIG. 1. The chain could be any chain-like elongated flexible member designed to enhance the jewelry aspect of the invention.

As can be seen clearly in FIGS. 3 and 4, stem tube or vial 16 is mounted within cylindrical number 11. Cap 17 is secured over the upper end of the vial and is formed with a small central opening 21 through which the stem of flower 22 is adapted to pass. Because of the size of hole 21 and the surface tension of water which may be held within vial 16, leakage of the water is unlikely, even if the vial is tilted on its side.

Vial 16 has a slight taper, smaller toward closed end 24. For this reason, the upper peripheral side wall adjacent the top surface of cap 17 provides a frictional engagement with the inside surface of cylinder 11 and retains it in position. Whenever it is desired to remove the vial, it can simply be pushed out in either direction by means of a pen, pencil or similar device. Because it is frictionally engaged but movable and removable, the vial may be positioned at different locations within cylinder 11 to accommodate different length flower stems or to enable the wearer to achieve different effects with the same flower.

In FIG. 5 the jewelry item of the invention is shown as a pin or broach. Cylindrical member 26 includes releasable pin assembly 27 secured to one side.

The present invention may be referred to as a bud pendant because it is a pendant-type piece of jewelry adapted to hold a flower or flower bud in a vial of water so that it retains its freshness for a significant period of time.

In view of the above description, it is likely that modifications and improvements will occur to those skilled in the art which are in the scope of the appended claims.

What is claimed is:

1. An item of jewelry adapted to hold a fresh cut flower in water, said jewelry item comprising;

a substantially rigid cylindrical member made of jewelry material;

means for securing said cylindrical member to a person to show it off as jewelry;

an elongated vial having a closed bottom end and an open top end; and resilient stopper means closing said top end of said vial, said stopper means having an opening therethrough which is substantially smaller than the opening of the top of said vial;

said vial being removably retained within said cylindrical member by means of said stopper means frictionally engaging the interior surface of said cylindrical member;

said vial being adapted to hold water and a portion of the stem of a cut flower extending through said opening in said stopper means so that the flower bud or blossom extends from said cylindrical member.

2. The item of jewelry recited in claim 1, wherein:

said securing means comprises a jewelry chain-like flexible elongated member; and said cylindrical member is formed with means for receiving said elongated member.

3. The item of jewelry recited in claim 2, wherein said receiving means comprises at least one opening through said cylindrical member through which said elongated member passes.

4. The item of jewelry recited in claim 3, wherein said opening in said cylindrical member is located adjacent the end of said cylindrical member juxtaposed with said stopper means.

5. The item of jewelry recited in claim 1, wherein said receiving means comprises a pin secured to the external surface of said cylindrical member.

6. The item of jewelry recited in claim 1, wherein said stopper means is wedged between the top, peripheral edge of said vial and said interior surface of said cylindrical member.

7. The item of jewelry recited in claim 6, wherein:

said cylindrical member, stopper means and top of said vial are in resilient interference fit;

whereby said vial and stopper means are secured within said cylindrical member and are separable therefrom by applying relative axial force to said vial and stopper means.

* * * * *